US010214326B1

(12) United States Patent
Gilliam et al.

(10) Patent No.: US 10,214,326 B1
(45) Date of Patent: Feb. 26, 2019

(54) TAMPER EVIDENT RING/BOTTLE SYSTEM

(71) Applicants: James R. Gilliam, Clearwater, FL (US); Gary E. Silke, Holmes Beach, FL (US)

(72) Inventors: James R. Gilliam, Clearwater, FL (US); Gary E. Silke, Holmes Beach, FL (US)

( * ) Notice: Subject to any disclaimer, the term of this patent is extended or adjusted under 35 U.S.C. 154(b) by 0 days.

(21) Appl. No.: 15/279,908

(22) Filed: Sep. 29, 2016

(51) Int. Cl.

| | |
|---|---|
| ***B65D 41/34*** | (2006.01) |
| ***B65D 1/02*** | (2006.01) |
| ***B65D 45/32*** | (2006.01) |
| ***B65D 50/00*** | (2006.01) |

(52) U.S. Cl.
CPC ..... *B65D 41/349* (2013.01); *B65D 1/0246* (2013.01); *B65D 45/32* (2013.01); *B65D 50/00* (2013.01)

(58) Field of Classification Search
CPC ..... B65D 41/349; B65D 50/00; B65D 45/32; B65D 1/0246
USPC ..... 215/252, 230, 328
See application file for complete search history.

(56) References Cited

U.S. PATENT DOCUMENTS

| | | | | |
|---|---|---|---|---|
| 4,055,266 | A * | 10/1977 | Amabili | B65D 41/42 215/252 |
| 4,805,791 | A * | 2/1989 | Begley | B65D 41/3447 215/252 |
| 5,219,084 | A * | 6/1993 | King | B65D 1/02 215/220 |
| 6,981,600 | B1 * | 1/2006 | Battegazzore | B65D 41/3442 215/230 |
| 2003/0102281 | A1 * | 6/2003 | Ryall | B65D 41/3438 215/252 |
| 2010/0018942 | A1 * | 1/2010 | Battegazzore | B65D 41/348 215/252 |

* cited by examiner

*Primary Examiner* — James N Smalley

(57) ABSTRACT

A one piece closure has a distal section, a proximal section, and an intermediate section. The intermediate section has a cylindrical center with a first annular fold extending radially inwardly and a second annular fold extending radially inwardly. The first and second folds are parallel forming an annular channel there between extending for less than 360 degrees creating a gap. The cylindrical center is formed with a hole. A C-shaped snap ring is positioned within the annular channel. The snap ring has spaced free ends. The snap ring has a projection sized to extend into the hole in the cylindrical center. The projection of the snap ring is of a first color. The remainder of the snap ring is of a second color.

5 Claims, 4 Drawing Sheets

FIG. 4
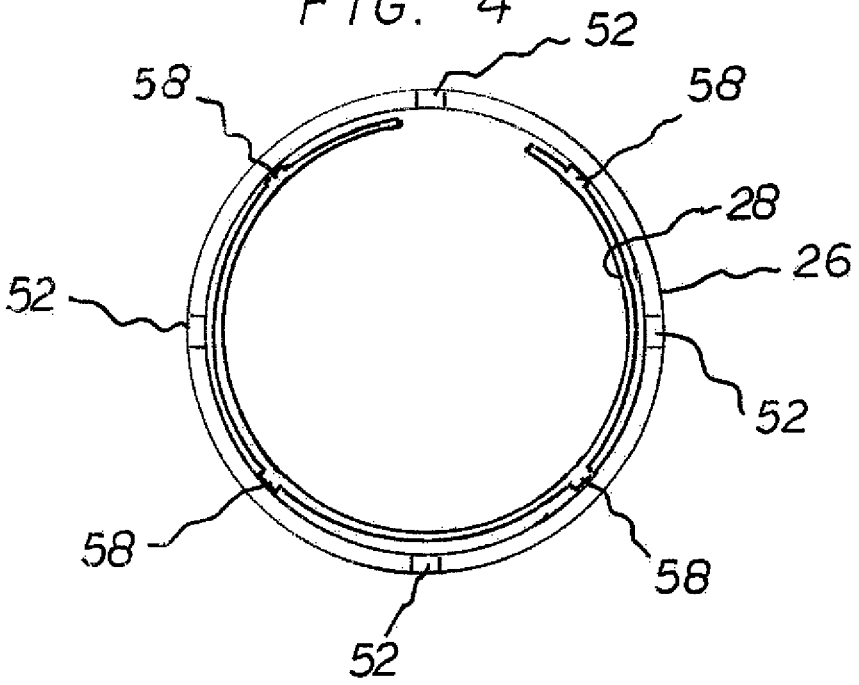
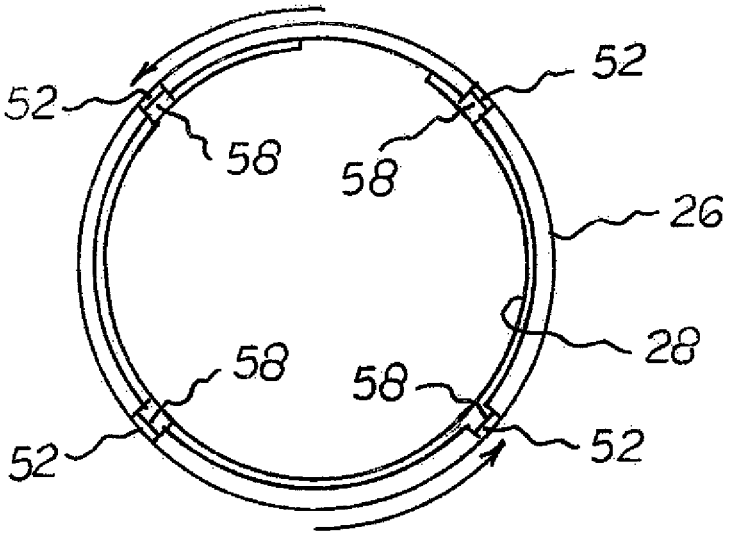
FIG. 5

FIG. 6
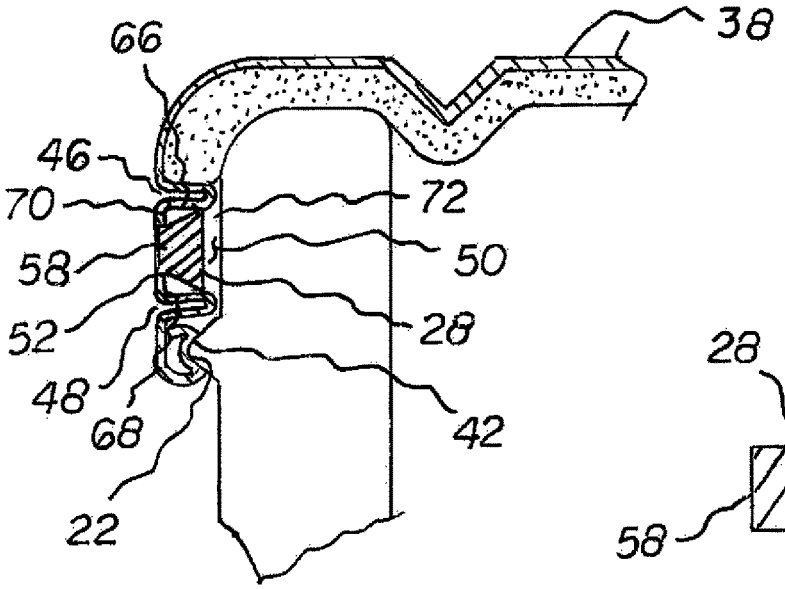
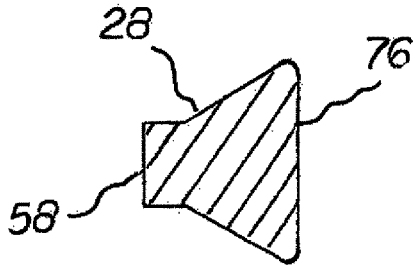
FIG. 6A
FIG. 7
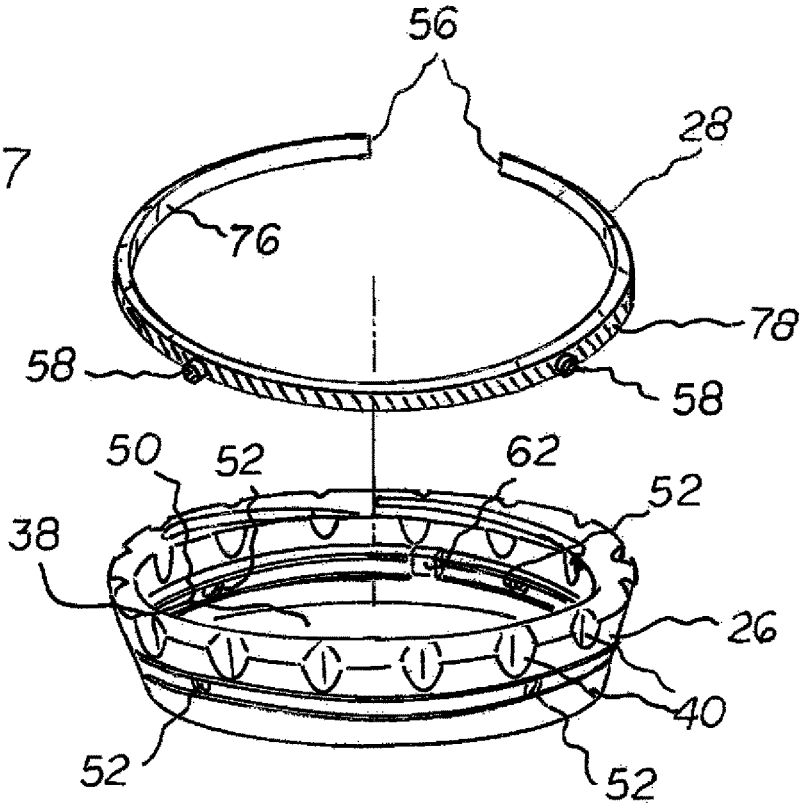

FIG. 8
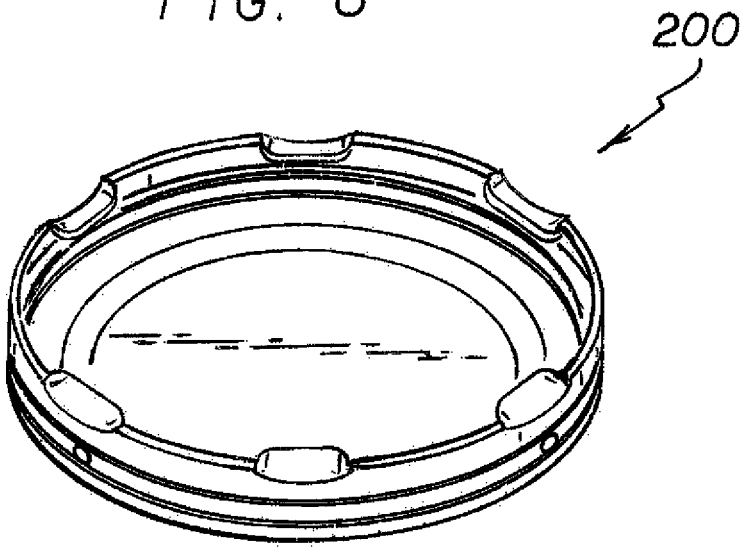
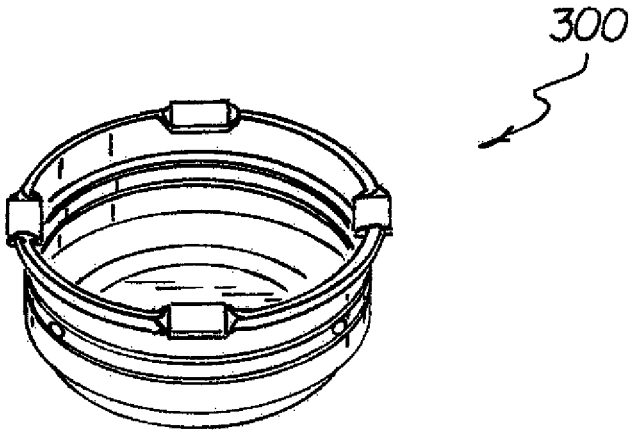
FIG. 9

TAMPER EVIDENT RING/BOTTLE SYSTEM

BACKGROUND OF THE INVENTION

Field of the Invention

The present invention relates to a tamper evident ring/closure system and more particularly pertains to sealing a container containing a food or beverage, providing evidence that freshness and safety and counterfeiting of the food or beverage has not been compromised, and displaying a warning if freshness or safety or counterfeiting has been compromised. The sealing, providing, and displaying are done in a safe, sanitary, convenient, and economical manner.

SUMMARY OF THE INVENTION

In view of the foregoing disadvantages inherent in the known types of tamper evident ring/closure system now present in the prior art, the present invention provides an improved tamper evident ring/closure system. As such, the general purpose of the present invention, which will be described subsequently in greater detail, is to provide a new and improved tamper evident ring/closure system and method which has all the advantages of the prior art and none of the disadvantages.

To attain this, from a broad perspective, the present invention essentially comprises a tamper evident ring/closure system. A one piece closure has a distal section, a proximal section, and an intermediate section. The intermediate section has a cylindrical center with a first annular fold extending radially inwardly and a second annular fold extending radially inwardly. The first and second folds are parallel forming an annular channel there between extending for slightly less than 360 degrees creating a small gap. The cylindrical center is formed with a hole. A C-shaped snap ring is positioned within the annular channel. The snap ring has spaced free ends. The snap ring has a projection sized to extend into the hole in the cylindrical center. The projection of the snap ring is of a first color. The remainder of the snap ring is of a second color.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tamper evident ring/closure system which has all of the advantages of the prior art tamper evident systems of known designs and configurations and none of the disadvantages.

It is another object of the present invention to provide a new and improved tamper evident ring/closure system which may be easily and efficiently manufactured and marketed.

It is a further object of the present invention to provide a new and improved tamper evident ring/closure system which is of durable and reliable constructions.

An even further object of the present invention is to provide a new and improved tamper evident ring/closure system which is susceptible of a low cost of manufacture with regard to both materials and labor, and which accordingly is then susceptible of low prices of sale, thereby making such tamper evident ring/closure system economically available.

Lastly, it is an object of the present invention to provide a tamper evident ring/closure system for sealing a container containing a food or beverage, providing evidence that freshness and safety and counterfeiting of the food or beverage has not been compromised, and displaying a warning if freshness or safety or counterfeiting has been compromised, the sealing, providing, and displaying being done in a safe, sanitary, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a cross sectional view taken along line 4-4 of FIG. 2.

FIG. 5 is a cross sectional view similar to FIG. 4 but with the crown cap twisted from the green/go orientation to the red/warning orientation.

FIG. 6 is a cross sectional view taken along line 6-6 of FIG. 2.

FIG. 6A is a cross-sectional view of the snap ring shown in FIG. 6.

FIG. 7 is an exploded perspective illustration of the crown cap and snap ring shown in the prior Figures.

FIG. 8 is a perspective illustration of a large lug-type closure.

FIG. 9 is a perspective illustration of a small lug-type closure

The same reference numerals refer to the same parts throughout the various Figures of the primary preferred embodiment of the invention as disclosed and claimed herein.

DESCRIPTION OF THE PREFERRED EMBODIMENT

Figure 1:
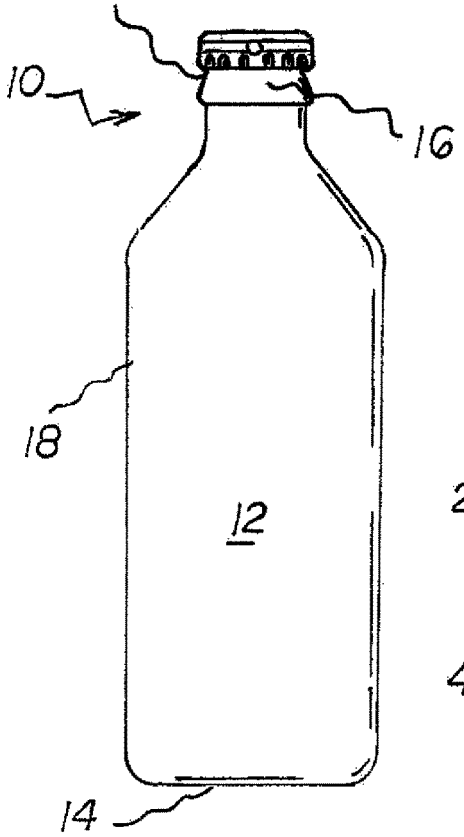
FIG. 1 is a front elevational view of a tamper evident ring/closure system constructed in accordance with the principles of the present invention.
Figure 2:
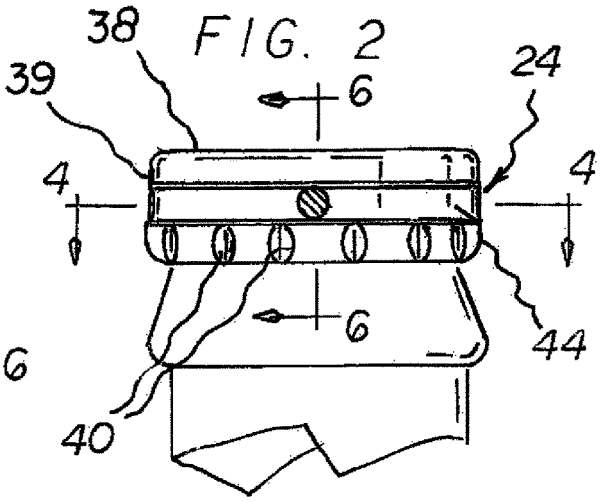
FIG. 2 is an enlarged front elevational view of the crown cap with the tamper evident snap ring and a portion of the bottle.
Figure 3:
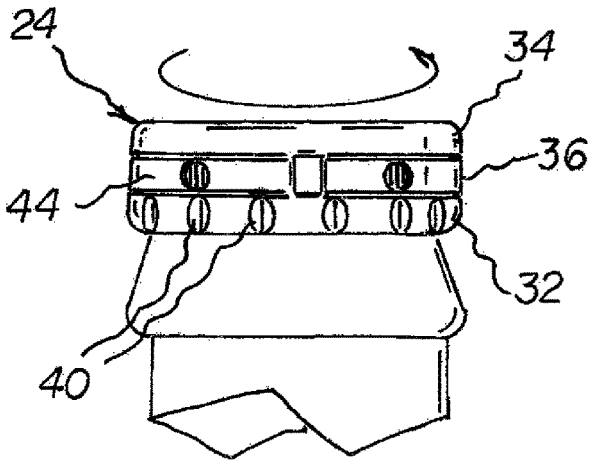
FIG. 3 is an enlarged front elevational view similar to FIG. 2 but with the crown cap twisted from the green/go orientation to the red/warning orientation.

With reference now to the drawings, and in particular to FIG. 1 thereof, the preferred embodiment of the new and improved tamper evident ring/closure system embodying the principles and concepts of the present invention and generally designated by the reference numeral 10 will be described.

The present invention, the tamper evident ring/closure system 10 is comprised of a plurality of components. Such components in their broadest context include a closure, an intermediate section, and a snap ring. Such components are individually configured and correlated with respect to each other so as to attain the desired objective.

To attain this, from a specific perspective, the present invention essentially comprises a tamper evident ring/closure system. First provided is a container illustrated as a bottle 12. Other containers adapted for use in the present invention include jars, packages, and the like. The container has a closed bottom 14 and an open top 16. The container has a peripheral side wall 18. The container has a neck 20 formed as a portion of the side wall. The neck is positioned to surround the open top. The neck has an exterior surface. The exterior surface of the neck has male screw threads 22.

A closure assembly 24 is next provided. The closure assembly includes a container shown in the primary preferred embodiment as crown cap 26. The closure is adapted to be of the screw on or crimp on variety. The closure assembly also includes a snap ring 28. The snap ring is rotatably coupled with respect to the closure. The closure, the snap ring, and the container share a common central axis.

The closure is of a one piece construction. The closure has a distal section 32 and a proximal section 34. The closure further has an intermediate section 36.

The distal section has a circular region 38 and a cylindrical region 39. The circular region covers the open top. The cylindrical region surrounds the neck adjacent to the open top. The cylindrical region has a first diameter.

The proximal section is generally cylindrical. The proximal section has notches 40 to facilitate crimping the closure to the container. The proximal section surrounds the neck spaced from the distal section and the open top. The proximal section has a second diameter equal to the first diameter. The proximal section has an interior surface. The interior surface of the proximal section has female screw threads 42. The female screw threads are adapted to rotatably couple to the male screw threads of the neck.

The intermediate section has a cylindrical center 44. The cylindrical center has a first annular fold 46. The first annular fold is I-shaped in configuration. The first annular fold extends radially inwardly. The intermediate section has a second annular fold. The second annular fold is I-shaped in configuration. The second annular fold extends radially inwardly. The first I-shaped fold is provided parallel with the second I-shaped fold. In this manner, an annular channel 50 is formed between the folds. The annular channel extends for 335 to 340 degrees. In this manner, a gap 50 is created. The gap is of 20 to 25 degrees. The cylindrical center has a first circumference. The cylindrical center has a third diameter equal to the first diameter and the second diameter. The cylindrical center has four holes 52. The holes extend through the cylindrical center at equally spaced circumferentially locations.

The snap ring is C-shaped in configuration. The snap ring is positioned within the annular channel. The snap ring has a second circumference. The second circumference is essentially equal to the first circumference. The snap ring has spaced free ends 56. The snap ring has four projections 58. The four projections are sized and located to extend into the holes in the cylindrical center. The projections of the snap ring are colored red. The remainder of the snap ring is colored green. The green of the snap ring is provided remote from the projections. The green of the snap ring is visible through the four holes when in a safe green/go orientation. Conversely, the red of the projections of the snap ring is visible through the four holes when in an unsafe red/warning orientation.

Provided last is a rectilinear block 62. The rectilinear block extending radially inwardly of the intermediate section filling the gap. The snap ring has an interior surface facing the neck of the container with a high coefficient of friction. The snap ring has an exterior surface facing the intermediate section with a low coefficient of friction. Rotation of the closure with respect to the container functions to slide the snap ring within the channel with the rectilinear block limiting movement of the snap ring with respect to the channel.

An operational chamber is formed in the closure assembly 24. The operational chamber 50 is bounded above by a generally horizontal upper surface 66 and bounded below by a generally horizontal lower surface 68. The operational chamber is bounded radially exteriorly by a cylindrical surface 70 and bounded radially interiorly by a cylindrical passageway 72. The cylindrical passageway has a first height. Radially exterior of the cylindrical passageway, the operational chamber has a varying height greater than the first height. The cylindrical surface has four circular apertures equally spaced circumferentially at 90 degrees.

Within the operational chamber is the snap ring 28. The snap ring has a cross sectional configuration in a trapezoidal configuration. The snap ring has an interior base 76 in a cylindrical configuration with a maximum second height radially interior of the cylindrical passageway. The second height is greater that the first height but less than the varying height. The snap ring has an exterior face 78 in a cylindrical configuration with a minimum height facing the cylindrical surface of the operational chamber. Four cylindrical projections 58 are in sliding contact with the cylindrical surface of the operational chamber with minimum frictional contact there between. The base is in contact with the container with maximum frictional contact there between.

FIGS. 8 and 9 illustrate lug-type closures adapted for use with various contents. such closures are characterized by opening and closing through less than a full rotation of the closure with respect to the container. A typical large lug-type closure 200 is used on pickle jars. A typical small lug-type closure 300 is used on energy drinks and food supplements.

An added feature of the present invention is a small supplemental projection in the neck of the container extending radially outwardly at an elevation above the screw threads. When the small supplemental projections are of a proper size and shape and location, it will assist in the intended rotation of the snap ring with respect to the closure along with movement of the colored cylindrical projections with respect to the associated holes.

During use, the four apertures of the closure assembly will appear green due to the color of the snap ring beneath the circular apertures. Twisting the closure assembly with respect to the container, including a slight tampering or slight twisting of the closure, will cause the snap ring to rotate with the container until the four red cylindrical projections are received in the four circular apertures. Thereupon, the snap ring will resile outwardly toward a linear configuration with the entire snap ring moving into the operational chamber. Evidence in the form of the red in the circular apertures will provided that there has been even slight tampering or twisting of the closure assembly with respect to the container. In addition, the separation of the snap ring from the closure assembly will be abated. This will preclude accidental ingesting of the snap ring by a person.

The present invention also includes a method of fabricating, modifying and incorporating a tamper evident snap ring system into various types of closures and containers creating a tamper evident alert feature in a closure. The presence of this feature eliminates the need for interior seals, tamper bands, and shrink wraps.

Modifying the closure is caused by forming two radially extending inward I-shaped folds, each fold being 2-3 millimeters in depth around the cylindrical center of the closure. The folds are equally sized and spaced 2-3 millimeters apart axially. This creates a three sided annular channel to accommodate a tamper evident snap ring or band.

An annular channel is located 0.75 millimeters, plus or minus 20 percent, spaced from the liner/gasket.

Modification of the closure or closure is by forming a plurality of 2-3 millimeter diameter holes evenly spaced circumferentially in the sidewall 1 millimeters, plus or minus 10 percent, from the liner/gasket. The holes are in alignment to match the spacing of the red projections or nipples on the tamper evident snap ring.

The holes are located in the center of the annular channel between to the two folds.

Formed next is an inward stop, 2-3 millimeters in height and width, to form a rotation stop for preventing the snap ring from turning as the closure is twisted off during removal from the container while making the red projections visible through the holes.

The stop is located in the center of the annular channel gap preventing the snap ring from turning clock wise which would otherwise remove the red projections from being visible and thereby cause a compromised beverage to appear uncompromised.

The snap ring s preferably fabricated of a semi-rigid 2-2.75 millimeter square or other shaped cross section that would be molded of a green plastic polymer.

Fabricate the green snap ring with a plurality of another vibrant color will increase visible evidence of tampering and of a compromised beverage. Such red projections are positioned evenly around the exterior surface of the snap ring corresponding to the holes.

The plastic snap ring is preferably 15-20 degrees larger in circumstance than the closure creating an outward pressure against the cylindrical center and holds the snap ring in the annular channel after the snap ring is initially placed inside the annular channel.

The snap ring is formed with a void of about of 20-25 degrees creating an opening in the circumstance between the red projections or nipples.

To place the snap ring into the annular channel, it is necessary to crimp the snap ring closing the void in the circumstance making it small enough to be placed inside the closure.

Based upon the foregoing, a visual alert system is created that when a closure is twisted on the container, a counter clockwise turn rotates the closure over the snap ring aligning the holes in the annular channel with the projections on the snap ring so that the red projections appear through the holes indicating the closure has been compromised, tampered with, or pilfered.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tamper evident ring/closure system comprising:

a closure being of a one piece construction with a distal section and a proximal section and an intermediate section;

the intermediate section having a cylindrical center with a first annular fold extending radially inwardly and a second annular fold extending radially inwardly, the first and second folds being parallel and forming an annular channel there between, the annular channel extending for 360 degrees less a gap, the cylindrical center being formed with a hole; and a snap ring having a C-shaped configuration and positioned within the annular channel, the snap ring having spaced free ends and a projection of a size to extend into the hole in the cylindrical center, the projection being of a first color, the snap ring being of second color except for the projection.

2. A tamper evident ring/closure and container system comprising:

a closure being of a one piece construction with a distal section and a proximal section and an intermediate section;

the intermediate section having a cylindrical center with a first annular fold extending radially inwardly and a second annular fold extending radially inwardly, the first and second folds being parallel and forming an annular channel there between, the annular channel extending for 360 degrees less a gap, the cylindrical center being formed with a hole;

a snap ring having a C-shaped configuration and positioned within the annular channel, the snap ring having spaced free ends and a projection of a size to extend into the hole in the cylindrical center, the projection being of a first color, the snap ring being of second color except for the projection; and a container having a closed bottom and an open top and a peripheral side wall, a neck formed as a portion of the side wall, the neck located to surround the open top.

3. The system as set forth in claim 2 and further including:

a rectilinear block extending radially inwardly of the intermediate section filling the gap and wherein the snap ring has an interior surface facing the neck of the container with a first coefficient of friction and wherein the snap ring has an exterior surface facing the intermediate section with a second coefficient of friction, the first coefficient of friction being higher than the second coefficient of friction, whereby rotation of the closure with respect to the container will slide the snap ring within the channel, the rectilinear block limiting movement of the snap ring with respect to the channel.

4. The system as set forth in claim 3 wherein:

the distal section of the closure has a circular region and a cylindrical region, the circular region covering the open top of the container, the cylindrical region surrounding the neck of the bottle adjacent to the open top of the container; and the proximal section of the closure is generally cylindrical with notches to facilitate crimping the closure to the container, the proximal section surrounding the neck of the container spaced from the distal section of the closure and the open top of the container.

5. A tamper evident ring/closure system (10) for sealing a container (12) containing a food/beverage, providing evidence that freshness, safety, and counterfeiting of the food/beverage has not been compromised, and displaying a warning if freshness, safety, counterfeiting has been compromised, the system comprising, in combination:

the container (12) having a closed bottom (14) and an open top (16) and a peripheral side wall (18), a neck (20) formed as a portion of the side wall, the neck located to surround the open top, the neck having an exterior surface with male screw threads (22);

a closure assembly (24) including a closure (26) and a snap ring (28), the snap ring being rotatably coupled with respect to the closure, the closure and the snap ring and the container sharing a common central axis;

the closure being of a one piece construction with a distal section (32) and a proximal section (34) and an intermediate section (36);

the distal section having a circular region (38) and a cylindrical region (38), the circular region covering the open top, the cylindrical region surrounding the neck adjacent to the open top, the cylindrical region having a first diameter;

the proximal section being generally cylindrical with notches (40) to facilitate crimping the closure to the container, the proximal section surrounding the neck spaced from the distal section and the open top, the proximal section having a second diameter equal to the first diameter, the proximal section having an interior surface with female screw threads (42) adapted to rotatably couple to the male screw threads;

the intermediate section having a cylindrical center (44) with a first annular fold (46) in an I-shaped configuration extending radially inwardly, the intermediate section having a second annular fold (48) in an I-shaped configuration extending radially inwardly, the first and second I-shaped folds being parallel and forming an annular channel (50) there between, the annular channel extending for 335 to 340 degrees creating a gap (50) of 20 to 25 degrees, the cylindrical center having a first circumference and a third diameter equal to the first and second diameter, the cylindrical center being formed with four holes (52) extending through the cylindrical center at equally spaced circumferentially locations;

the snap ring having a C-shaped configuration and positioned within the annular channel, the snap ring having a second circumference essentially equal to the first circumference, the snap ring having spaced free ends (56) the snap ring having four projections (58) of a size and location to extend into the holes in the cylindrical center, the projections being colored red, the snap ring having a color green except for the projections, the green of the snap ring remote from the projections being visible through the four holes when in a safe green/go orientation but the red of the snap ring being visible through the four holes when in an unsafe red/warning orientation; and a rectilinear block (62) extending radially inwardly of the intermediate section filling the gap, the snap ring having an interior surface facing the neck of the container with a first coefficient of friction, the snap ring has an exterior surface facing the intermediate section with a second coefficient of friction, the first coefficient of friction being higher than the second coefficient of friction, rotation of the closure with respect to the container functioning to slide the snap ring within the channel with the rectilinear block limiting movement of the snap ring with respect to the channel.

* * * * *